US007262160B2

(12) United States Patent
Black

(10) Patent No.: US 7,262,160 B2
(45) Date of Patent: Aug. 28, 2007

(54) DYE PRODUCT AND METHOD OF TREATING CLOTHING FOR UV BLOCKING

(76) Inventor: Robert H. Black, 4858 Mariner Point, Jacksonville, FL (US) 32225

( * ) Notice: Subject to any disclaimer, the term of this patent is extended or adjusted under 35 U.S.C. 154(b) by 359 days.

(21) Appl. No.: 10/859,116

(22) Filed: Jun. 3, 2004

(65) Prior Publication Data

US 2004/0266640 A1 Dec. 30, 2004

Related U.S. Application Data

(60) Provisional application No. 60/483,056, filed on Jun. 30, 2003.

(51) Int. Cl.
*C11D 3/40* (2006.01)
*D06M 11/00* (2006.01)

(52) U.S. Cl. ..... 510/394; 510/293; 510/294; 510/298; 510/446; 252/8.91; 8/137; 8/648

(58) Field of Classification Search ..... 510/394, 510/293, 294, 296, 298, 446; 8/648, 137; 252/8.91
See application file for complete search history.

(56) References Cited

U.S. PATENT DOCUMENTS 5,225,100 A * 7/1993 Fry et al. ..... 510/298
5,637,348 A 6/1997 Thompson et al.
5,990,058 A * 11/1999 Bac et al. ..... 510/120
6,015,504 A 1/2000 Reinehr et al.
6,080,208 A * 6/2000 Reinehr et al. ..... 8/115.7
6,306,814 B1 * 10/2001 Appel et al. ..... 510/446
6,448,212 B1 * 9/2002 Holderbaum et al. ..... 510/296
6,610,214 B2 8/2003 Goldenhersch et al.
6,641,920 B2 11/2003 Conn et al.
2001/0031714 A1 * 10/2001 Gassenmeier et al. ..... 510/276
2002/0086039 A1 * 7/2002 Lee et al. ..... 424/401
2004/0063597 A1 * 4/2004 Adair et al. ..... 510/276
2004/0063598 A1 * 4/2004 Riebe et al. ..... 510/293
2004/0259751 A1 * 12/2004 Kessler et al. ..... 510/293

* cited by examiner

*Primary Examiner*—Lorna M Douyon
(74) *Attorney, Agent, or Firm*—Browdy and Neimark, PLLC

(57) ABSTRACT

Enhanced UV blocking is provided to clothing by washing the clothing in a composition including a UV blocking dye and at least one additional water-soluble material which serves as a matrix and/or a dispersant for the dye in the washing machine. The dye is initially in the form of a solid tablet or pellet preferably also containing a disintegrant, or inside a water-soluble envelope. When placed in the washing machine with the clothing and the washing water, the pellet or tablet disintegrates and dissolves releasing the UV protectant dye to the clothing.

6 Claims, No Drawings

DYE PRODUCT AND METHOD OF TREATING CLOTHING FOR UV BLOCKING

This application is based on provisional application Ser. No. 60/483,056, filed Jun. 30, 2003, and claims the priority thereof.

FIELD OF INVENTION

The present invention relates to a UV protectant product in tablet or pellet form, or water-soluble package containing the dye in loose powder form, and a method of domestic or industrial use thereof in treating fabrics to impart more resistant to ultraviolet (UV) light passage therethrough.

BACKGROUND OF THE INVENTION

The public is becoming increasingly aware of damage to the skin caused by sunlight, and particularly the ultraviolet (UV) components of sunlight, such damage including various types of skin cancers and early "leathering" and aging of the skin. As a result of this knowledge, sunscreen lotions and creams, as well as cosmetics containing sunscreens, are now available and sold to the public in increasing varieties and amounts, and at various protection (SPF) levels.

Although also well known, but less well known than damage caused to uncovered skin by UV, sunlight also passes through clothing, more or less depending on the openness of the fabric from which the clothing is made and the material itself. For example, normal light weight cotton clothing, commonly worn in summer, is relatively poor in blocking UV rays. Cotton is not a strong UV absorber and UV light is only moderately attenuated when it passes through normal cotton clothing. There is accordingly a need for blocking UV rays that pass through normal cotton clothing, especially the lightweight type commonly used in summer time, e.g. T-shirts and the like, as well as clothing made from other fabrics as well, e.g. cotton-polyester blends, nylon, nylon blends, and also regenerated cellulose, flax, linen, etc., and blends thereof with one another or other fibers.

There are UV-blocking clothes on the market that permit air-flow while blocking UV, but these clothes tend to be expensive. Some relatively recent U.S. patents which relate to the industrial treatment of yarns, fibers, fabrics and finished textiles to enhance their UV absorption or attenuation include U.S. Pat. Nos. 5,637,348; 6,015,504; 6,610,214 and 6,641,920.

Because factory-UV-treated textiles are quite expensive, it would be desirable to provide means for treating clothing, especially lightweight summer clothing, in the home, i.e. domestically, and there are basically three ways to do this, namely: (1) incorporating the UV attenuation or blocking material in a laundry detergent composition, (2) providing such a material as a separate powder for use with a laundry detergent, or (3) in accordance with the present invention as described below.

Incorporation of the UV blocking material with laundry detergent is inconvenient because the household then needs to have two different kinds of laundry detergents, one including the blocking material and one not including the blocking material; or, alternatively, a single household detergent can be used containing the UV protectant material, but in that case the cost increases substantially because articles such as linens, underwear and bed clothing are also impregnated with UV protectant, which is unnecessary and wasteful.

The second option is one commercially available, noting for example the Rit® Sun Guard™ Laundry Treatment (see www.ritdye.com/sun_guard/faq.asp). The Rit® system, which includes Tinosorb™ FD, a UV protectant produced by CIBA Specialty Products as active ingredient, requires its use with laundry detergent, i.e. it is simply added as a powder to the regular wash load, preferably without the addition of chlorine bleach. While this system is an improvement over incorporating the UV protectant in the laundry detergent, it also is not convenient because separate doses must be pre-packaged for different wash loads, or there is always a measurement problem. In addition, opening the packet of the UV protectant powder and dumping the entire contents or a portion of the powder into the washing machine creates a danger from possible inhalation of some of the powder.

SUMMARY OF THE INVENTION

It is, accordingly, an object of the present invention to at least partially overcome at least some of the problems in the prior art as indicated above, and/or to provide some degree of improvement of means and/or methods for enhancing the ability of textiles to absorb or attenuate UV, preferably at a lower cost and/or in a more convenient and/or safe way.

One or more of the above objects are achieved in accordance with the present invention by providing a UV protectant material, hereinafter sometimes referred to as UV protectant dye, in composition form as either a powder in a dissolvable package or in tablet or pellet form, which can be added to a washing machine, e.g., a home washing machine, either with conventional detergent or by itself. The UV protectant composition desirably includes a water-soluble material as the matrix to allow for dispersion of the UV protectant dye which does not interfere with normal clothes washing, and which enhances storage stability. The tablet or pellet form, which can be either made by melting and casting, or by compression of a powder, desirably also comprises a disintegrant.

The pellet or tablet form is particularly advantageous in that the UV protectant dye can then be provided in such a way that doses can be easily calibrated to the load of clothes being treated. For example, for a small load, one pellet or tablet can be used. For medium load, two such pellets or tablets can be used; and for a large load, three such pellets or tablets for example can be used. The powdered form in small dissolvable packages of different sizes can be similarly provided.

Providing a satisfactory pellet or tablet is not easy because of the necessity that the pellet or tablet fully disperse and dissolve in the washing machine during use. Therefore, when the composition is provided in pellet or tablet form, a dispersing agent, and particularly one readily dissolvable in water, should be present, as well as a disintegrating agent.

DETAILED DESCRIPTION OF EMBODIMENTS

In general, the UV protectant composition of the present invention includes a UV protectant dye, desirably Tinosorb™ FM from CIBA, together with at least one matrix and dispersant material, e.g. a single material which provides both matrix and dispersion function, or at least one material which provides mostly or entirely a dispersion function and another material which provides mostly or entirely a matrix function.

An excellent and inexpensive agent which serves dispersant and matrix functions is simple sugar, e.g. powdered sucrose, but the dispersant can be almost any solid material which is water soluble, including polyethylene glycol, alcohol ethoxylates, carbonates, bicarbonates, water-soluble polymers, block copolymer surfactants, and even hydrocarbons with sufficient hydroxy radicals to be soluble, as well as various mixtures of two or more of these. Sodium sulfate, sodium carbonate, citric acid and non-ionic surfactant worked not as well. Routine testing is all that is necessary to determine suitable matrix and dispersant components.

UV protectant dyes may also be routinely tested for suitability. A large number of these are disclosed in the aforementioned U.S. Pat. No. 6,015,504.

The relative quantities of UV protectant dye with respect to the matrix, dispersant and disintegrant in the case of the pellet or tablet form depends to some extent on the size of the water-soluble package or of the pellet or tablet. In general, the size of the water-soluble package and of the pellet or tablet should be in the range from about 2 grams to about 30 grams, more desirably no larger than 20 grams, but is preferably of a size of about 3-8 grams, and most preferably about 4 grams. On the other hand, the water-soluble package can be made larger, if desired, by the inclusion of various fillers, e.g. detergent powder or even inert fillers of various types.

The quantity of UV-protectant dye in each water-soluble package or in each pellet or tablet will depend on the size of the pellet or tablet, and whether the water-soluble package or the pellet or tablet is intended for a small load, a medium load or a large load. This may be determined by routine testing, but for tablet or pellet of 4 grams there should be a minimum of 2% and a maximum of 60% of UV protectant dye based on the total weight of the pellet or tablet, preferably 8% to 50%, and more preferably 12% to 35%. In the case of the water-soluble package, the powder composition therewithin may comprise 100% of the dye, although it is preferred that lesser percentages be used, with the balance being detergent powder, inert fillers, and/or water soluble dispersants in powder form, such as those mentioned above, e.g. polyethylene glycol, alcohol ethoxylates, carbonates, etc.

For the pellet or tablet form, it is desirable to include a disintegrant as part of the composition. Although other disintegrants can be used, the preferred disintegrant is a commercial product sold by FMC Corporation under the trademark Ac-Di-Sol®, which is an internally-cross linked form of sodium carboxymethylcellulose, the chemical name of which is croscarmellose sodium, which differs from sodium carboxymethylcellulose only in that it has been cross-linked to insure that it is essentially water insoluble. Croscarmellose sodium aids in the disintegration and dissolution of the pellets or tablets, and improves the long-term stability thereof.

If the tablet or pellet is made by pressing powder, it is desirable to use a conventional mold lubricant such as magnesium stearate to prevent the pressed tablet or pellet from sticking to the inside of the mold. A bittering agent, such as Bitrex, is also desirably included to inhibit accidental consumption by children.

For a 4 gram tablet or pellet, presently considered the optimum size, the minimum and maximum preferred quantities of components are as follows:

| | |
|---|---|
| For minimum: | |
| UV protectant | |
| Dye | 2% |
| Disintegrent | 1% |
| Magnesium Stearate | 0% |
| Sugars and/or other matrix/dispersants | balance |
| For maximum: | |
| UV protectant | |
| Dye | 60% |
| Disintigrent | 20% |
| Magnesium Stearate | 10% |
| Sugars and/or other matrix/dispersants | balance |

For the dissolvable package form of the present invention, the components are desirably in mixed powdered form, and the envelope surrounding the powder is formed of a suitable water soluble polymer such as polyvinyl alcohol or polyvinyl pyrrolidine, although other water soluble films can be used.

The present invention is particularly adapted for domestic use in the home washing machine, although alternatively it of course can be used commercially or industrially. Particularly for home use, the UV protectant product of the present invention is desirably provided within an outer package, in the form of single use products of one size or preferably at least two different sizes, e.g., a first size for a small load of clothes to be treated, and a second larger size for a larger load of clothes to be treated. For example, in the case of providing the product in the form of tablets or pellets, 4 gram pellets can be provided for a small load and 6 or 8 gram pellets for a large load, the latter for example including 50%-100% more UV protectant dye. Of course, the packaging is not limited to the incorporation of only two sizes of pellets or tablets, or two sizes of water dissoluble packages, but may include three or more sizes for different size loads.

In use, the water soluble packets or the pellets or tablets are simply added to the washing machine with the clothes to be treated, either with or without detergent, and the normal clothes washing cycle is run. In the case where the consumer is provided with water soluble packages or with pellets or tablets of only one size suitable for a small load, directions would desirably be provided to inform the consumer that, for example, one pellet or tablet or one water soluble packet should be used for a small load, two for a medium load, and three for a large load; or, again depending on the dosage size, one tablet, pellet or water soluble package for a small load and two for a large load.

The following specific examples are offered illustratively, but not limitatively.

EXAMPLE 1

A 4 gram tablet was pressed from the following mixture of powders, the UV protectant dye being Tinosorb™ FD, obtained from Ciba Specialty Products.

| | |
|---|---|
| Dextrose | 64% |
| Sorbitol | 10% |
| UV Protectant Dye | 21% |
| Ac-Di-Sol | 4% |
| Magnesium Stearate | 1% |
| Bitrex | 0.0003% |

EXAMPLE 2

A 10 gram tablet was formed comprising 7% Tinosorb™ FD and 93% Pluronic F98 block copolymer surfactant from BASF.

EXAMPLE 3

A 10 gram tablet was formed similar to that of Example 2 comprising 7% Tinosorb™ FD and 93% TB-970 alcohol ethoxylate from RHODIA.

EXAMPLE 4

A 7 gram tablet was pressed from a mixture of 10% Tinosorb™ FD and 90% powdered sucrose. This tablet was tested against a control fabric having a measured UPF (Ultraviolet Protection Factor) of average 6.91, with a standard deviation of 0.21. The treated fabric had an average UPF of 28.66 with a standard deviation of 1.44.

EXAMPLE 5

A 7 gram tablet formed of 90% pluronic F98 non-ionic surfactant from BASF (compare Example 2) and 10% Tinosorb™ FD was tested against the aforementioned control, and provided the fabric with a UPF average of 26.81 with a standard deviation of 2.33.

EXAMPLE 6

The tablet of Example 5 was tested together with one-half cup of Cheer clothes detergent. The resultant fabric had a UPF average of 21.36 with a standard deviation of 2.29.

EXAMPLE 7

The tablet of Example 5 was tested along with 100 grams of Antarox BL-225, a non-ionic surfactant from Rhodia, together with 20 grams of EDTA. The resultant fabric had a UPF average of only 11.69, with a standard deviation of 0.43.

EXAMPLE 8

Results of Efficacy Testing

The objective of this series of tests was to determine the effectiveness of the UV Protectant of the present invention under various home-washing scenarios.

There were ten sets of test samples prepared for UPF evaluation. The cloth used in these tests was a more open weave than the test cloth used in Example 4-7. This more open weave resulted in lower UPF of the control as well as effectively making an upper bound on the treated items. All samples were White, 100% woven cotton, approximately 7.5×33 inches.

The tablets used were 0.980" in diameter and 0.268" thick at the edge with a 0.023" indent. The tablets weighed 4 grams and were pressed from the following composition:

| | |
|---|---|
| Dextrose | 64% |
| Sorbitol | 10% |
| Tinosorb dye | 21% |
| Ac-Di-Sol | 04% |
| Mag. St. | 01% |

After treatment in the washing machine as indicated below, and drying and transport to the test instrument, the treated fabrics were conditioned at 70° F. at 69% relative humidity for one hour before measurement on the Labsphere UV Transmittance analyzer. Measurements were made on a single thickness at four different locations, rotating 90° between measurements. Precautions were used in handling the fabric to prevent the transfer of skin oils and to minimize any stretching. The UPF measurement and analysis conditions were as follows.

TABLE 1

| | |
|---|---|
| Instrument: | Labsphere UV Transmittance Analyzer, UV1000F, Version 1.57 |
| Wavelength Range: | 290–400 nm |
| No. of Scans Per Area of Analysis on the Fabric: | 4, different locations |
| Light Source: | Xenon |
| SPF Solar Irradiance: | Noon, July 3, Albuquerque, NM |
| Fabric Thickness: | 1 layer |

The samples from each test set were analyzed and included the following number of fabrics.

Sample 1-4 fabrics
Sample 2-4 fabrics
Sample 3-2 fabrics
Sample 4-4 fabrics
Sample 5-2 fabrics
Sample 6-2 fabrics
Sample 7-2 fabrics
Sample 8-2 fabrics
Sample 9-3 fabrics
Sample 10-3 fabrics The following values were recorded:

UPF Rating (AS/NZS 4399:1996)
Mean UPF value
Standard deviation of the mean UPF value
Coefficient of Variation (COV), expressed as a percent
% Transmittance of UV in the UV-A wavelength range (315-400 nm)
% Transmittance of UV in the UV-B wavelength range (280-315 nm)

The results for both UPF Rating and Mean UPF were included in the evaluation. The Mean UPF value is the average UPF value of the four measurements taken on each fabric sample and is calculated as follows:

$$\bar{x} = \frac{1}{n}\sum_{i=1}^{n} x_i$$

Mean:

Where:

n=the total number of measurements or scans $x_i$=the UPF value of each individual measurement, i The UPF rating, which is based on the Australian/New Zealand standard 4399:1996, takes into account the variation or standard deviation between the measurements. This rating is calculated by subtracting the standard deviation from the mean UPF value, then rounding this value down to the nearest multiple of 5.

The standard deviation indicates the amount of variation that exists between the measurements. The coefficient of variation expresses the deviation as a percentage of the mean UPF. Higher values indicate higher variations.

The standard deviation and coefficient of variation are calculated as follows:

Standard Deviation:

$$s = \sqrt{\frac{\sum_{i=1}^{n}(x_i - \bar{x})^2}{n-1}}$$

Where:

n=the total number of measurements or scans $x_i$=the UPF value of each individual measurement, i Coefficient of Variation: COV=Standard deviation/Mean UPF×100

The results from the analysis of the fabrics and the conditions of treatment are shown in Table 2-11 below for the UPF rating and mean UPF. The % Transmittance for the UV-A and UV-B regions is also included. The fabrics within each sample set were arbitrarily labeled.

Visual assessment (natural daylight) of the fabric after treatment shows appearance is uniform with no indications of streaks. Results for each fabric are summarized in Table 12.

Sample 1

Woven cotton cloth was cut into strips across the full width of the cloth, i.e. 36". These strips were then hemmed to prevent unraveling. These strips were examined under a UV light and it was determined that they had been treated with a brightening agent. All of the strips were washed in a Kenmore 90 plus series set for large wash, hot wash, cold rinse, single rinse, fast agitation, Ultra clean 14-minute cycle. Eight ounces of 6% bleach was added to the water as the water was flowing into the machine and the agitation was allowed to run for 20 seconds before the strips were added. After washing all of the strips were hung on plastic hangers to dry. Washing caused the strips to shrink approximately 8%.

The strips were observed with a UV light source after washing. The brightening agent appeared to have been removed by the washing in the bleach solution, but the thread used for hemming still had brightening residual.

The strips described above were the control and were treated as shown in samples 2-10 below to determine the effects of the tablets of the present invention.

TABLE 2

| Fabric Identification | UPF Rating | Mean UPF | Std Dev | COV | UV-A % T | UV-B % T |
|---|---|---|---|---|---|---|
| 1-A | 1 | 4.79 | 0.22 | 4.65 | 34.41 | 16.65 |
| 1-B | 1 | 4.95 | 0.10 | 2.06 | 34.04 | 15.91 |
| 1-C | 1 | 4.98 | 0.16 | 3.23 | 33.91 | 15.77 |
| 1-D | 1 | 4.82 | 0.22 | 4.59 | 34.41 | 16.49 |
| Average | 1 | 4.89 | 0.18 | 3.63 | 34.19 | 16.21 |

Sample 2

Strip sets 2 through 10 were washed in a Kenmore 90 plus series set for small wash, single rinse, cold rinse, normal agitation, Ultra clean 14-minute cycle. When detergents were used either ⅓ cup of Tide Deep Clean 40086750 or ⅓ cup of Purex Deep Down Original Scent was added. The detergent was added to the water during the fill and the strips were added before the agitation started.

The Sample 2 set of strips were washed with a UV Protectant tablet as disclosed above, without detergent and with hot water.

TABLE 3

| Fabric Identification | UPF Rating | Mean UPF | Std Dev. | COV | UV-A % T | UV-B % T |
|---|---|---|---|---|---|---|
| 2-A | 20 | 26.17 | 2.91 | 11.13 | 4.16 | 3.68 |
| 2-B | 20 | 27.30 | 1.88 | 6.92 | 3.97 | 3.50 |
| 2-C | 20 | 23.82 | 1.86 | 7.81 | 4.55 | 4.02 |
| 2-D | 25 | 26.02 | 1.08 | 4.15 | 4.15 | 3.66 |
| Average | 21 | 25.83 | 1.93 | 7.50 | 4.21 | 3.72 |

Sample 3

The Sample 3 strips were washed with the UV Protectant tablet as disclosed above, without detergent and with warm water.

TABLE 4

| Fabric Identification | UPF Rating | Mean UPF | Std Dev. | COV | UV-A % T | UV-B % T |
|---|---|---|---|---|---|---|
| 3-A | 15 | 22.82 | 3.63 | 15.91 | 4.83 | 4.24 |
| 3-B | 20 | 22.53 | 1.47 | 6.51 | 4.80 | 4.23 |
| Average | 18 | 22.68 | 2.55 | 11.21 | 4.82 | 4.24 |

Sample 4

The Sample 4 strips were washed with the aforementioned UV Protectant tablet, with Tide detergent and with hot water.

TABLE 5

| Fabric Identification | UPF Rating | Mean UPF | Std Dev. | COV | UV-A % T | UV-B % T |
|---|---|---|---|---|---|---|
| 4-A | 15 | 20.95 | 0.95 | 4.55 | 4.90 | 4.57 |
| 4-B | 15 | 21.00 | 1.40 | 6.69 | 4.89 | 4.57 |
| 4-C | 15 | 22.52 | 3.07 | 13.62 | 4.60 | 4.31 |
| 4-D | 15 | 20.50 | 0.95 | 4.62 | 5.01 | 4.67 |
| Average | 15 | 21.24 | 1.59 | 7.37 | 4.85 | 4.53 |

Sample 5

The Sample 5 strips were washed with the present UV Protectant tablet, with Purex detergent and with hot water.

TABLE 6

| Fabric Identification | UPF Rating | Mean UPF | Std Dev. | COV | UV-A % T | UV-B % T |
|---|---|---|---|---|---|---|
| 5-A | 20 | 24.58 | 0.57 | 2.32 | 4.16 | 3.92 |
| 5-B | 20 | 24.71 | 0.94 | 3.80 | 4.14 | 3.90 |
| Average | 20 | 24.65 | 0.76 | 3.06 | 4.15 | 3.91 |

Sample 6

The Sample 6 strips were washed with the present UV Protectant tablet, with Tide detergent and with warm water.

TABLE 7

| Fabric Identification | UPF Rating | Mean UPF | Std Dev. | COV | UV-A % T | UV-B % T |
|---|---|---|---|---|---|---|
| 6-A | 15 | 19.76 | 1.45 | 7.35 | 5.21 | 4.86 |
| 6-B | 15 | 19.52 | 1.44 | 7.38 | 5.29 | 4.93 |
| Average | 15 | 19.64 | 1.45 | 7.37 | 5.25 | 4.90 |

Sample 7

The Sample 7 strips were taken from a portion of the Sample 2 strips, washed with the present UV Protectant tablet, without detergent and with hot water.

TABLE 8

| Fabric Identification | UPF Rating | Mean UPF | Std Dev. | COV | UV-A % T | UV-B % T |
|---|---|---|---|---|---|---|
| 7-A | 20 | 26.59 | 2.50 | 9.41 | 3.93 | 3.66 |
| 7-B | 20 | 28.08 | 3.71 | 13.20 | 3.74 | 3.49 |
| Average | 20 | 27.34 | 3.11 | 11.31 | 3.84 | 3.58 |

The Sample 8 strips were taken from a portion of the Sample 6 set of strips, washed with the present UV Protectant tablet, Tide detergent and in warm water.

Sample 8

TABLE 9

| Fabric Identification | UPF Rating | Mean UPF | Std Dev. | COV | UV-A % T | UV-B % T |
|---|---|---|---|---|---|---|
| 8-A | 20 | 23.32 | 2.09 | 8.94 | 4.38 | 4.17 |
| 8-B | 20 | 23.74 | 0.99 | 4.16 | 4.29 | 4.08 |
| Average | 20 | 23.53 | 1.54 | 6.55 | 4.34 | 4.13 |

The Sample 9 strips were taken from a portion of the Sample 4 set of strips, exposed to sun on Sep. 14, 2003. These strips were hung on a line strung on a boat on a lake at 81° 26.92 West, at 30° 20.08 North, at exactly North South so that the sun could shine on both sides. The strips were hung on the line the night before and removed at sunset, i.e. 7:33 PM. In the morning the sun shown on the east side of the strips and in the afternoon the sun shown both directly and reflected from the water on the West side. These strips were then washed without the UV Protectant tablet of the present invention, with Tide detergent and with warm water.

Sample 9

TABLE 10

| Fabric Identification | UPF Rating | Mean UPF | Std Dev. | COV | UV-A % T | UV-B % T |
|---|---|---|---|---|---|---|
| 9-A | 15 | 18.57 | 1.92 | 10.36 | 6.04 | 5.08 |
| 9-B | 15 | 19.02 | 0.95 | 5.00 | 5.90 | 4.92 |
| 9-C | 15 | 19.18 | 1.96 | 10.24 | 5.85 | 4.90 |
| Average | 15 | 18.92 | 1.61 | 8.53 | 5.93 | 4.97 |

The Sample 10 strips were taken from a portion of the Sample 4 set of strips, washed with the present UV Protectant tablet, with Tide detergent and in hot water.

Sample 10

TABLE 11

| Fabric Identification | UPF Rating | Mean UPF | Std Dev. | COV | UV-A % T | UV-B % T |
|---|---|---|---|---|---|---|
| 10-A | 25 | 27.38 | 0.92 | 3.35 | 3.72 | 3.54 |
| 10-B | 20 | 27.00 | 3.80 | 14.07 | 3.81 | 3.64 |
| 10-C | 20 | 27.81 | 2.67 | 9.59 | 3.68 | 3.50 |
| Average | 22 | 27.40 | 2.46 | 9.00 | 3.74 | 3.56 |

TABLE 12

Visual Assessment of Each Fabric Type.

| Fabric Sample Identification | Visual Observation of Fabric Appearance[1] |
|---|---|
| 1-A | Uniform and Dull white |
| 1-B | Uniform and Dull white |
| 1-C | Uniform and Dull white |
| 1-D | Uniform and Dull white |
| 2-A | Uniform and White |
| 2-B | Uniform and White |
| 2-C | Uniform and White |
| 2-D | Uniform and White |
| 3-A | Uniform and White |
| 3-B | Uniform and White |
| 4-A | Uniform and White |
| 4-B | Uniform and White |
| 4-C | Uniform and White |
| 4-D | Uniform and White |
| 5-A | Uniform and White |
| 5-B | Uniform and White |
| 6-A | Uniform and White |
| 6-B | Uniform and White |
| 7-A | Uniform and White with a slight pale green tint |
| 7-B | Uniform and White with a slight pale green tint |
| 8-A | Uniform and White |
| 8-B | Uniform and White |
| 9-A | Uniform and White |
| 9-B | Uniform and White |
| 9-C | Uniform and White |
| 10-A | Uniform and White |
| 10-B | Uniform and White |
| 10-C | Uniform and White |

[1]GretagMacbeth Spectralight III, Daylight ($D_{65}$ illuminant).

EXAMPLE 9

Woven cotton cloth of 36" width was cut into strips across the full width of the cloth. These strips were then hemmed to prevent unraveling. These strips were examined under a UV light and it was determined that they had been treated with a brightening agent. All of the strips were washed in a Kenmore 90 plus series set for large wash, hot wash, cold rinse, single rinse, fast agitation, Ultra clean 14-minute cycle. Eight ounces of 6% bleach was added to the water as the water was flowing into the machine and the agitation was allowed to run for 20 seconds before the strips were added. After washing all of the strips were hung on plastic hangers to dry. After washing and drying the strips were approximately 7" long and 33" wide, representing an approximate 8% shrinkage.

The strips were observed with a UV light source after washing. The brightening agent appeared to have been removed by the washing in the bleach solution but the thread used for hemming still had brightening residual.

The strips described above were the control.

A 4 gram tablet of the same composition as in Example 8 was used to add UV protection.

Strip sets 2 through 10 were washed in a Kenmore 90 plus series set for small wash, single rinse, cold rinse, normal agitation, Ultra clean 14-minute cycle. When detergents were used either ⅓ cup of Tide Deep Clean 40086750 or ⅓ cup of Purex Deep Down Original Scent was added. The detergent was added to the water during the fill and the strips were added before the agitation started.

The attached Table 13 describes how each of the sets of strips was treated.

TABLE 13

| Strip set | Source | Tablet | Wash | Detergent |
|---|---|---|---|---|
| 1 | Control | No | No | N/A |
| 2 | Control | Yes | Hot | None |
| 3 | Control | Yes | Warm | None |
| 4 | Control | Yes | Hot | Tide |
| 5 | Control | Yes | Hot | Purex |
| 6 | Control | Yes | Warm | Tide |
| 7 | 2 | Yes | Hot | None |
| 8 | 6 | Yes | Warm | Tide |
| 9 | 4* | No | Warm | Tide |
| 10 | 4 | Yes | Hot | Tide |

As in Example 8, strip set 9 used strips taken from strip set 4 and exposed to sun on Sep. 14, 2003. These strips were hung on a line strung on a boat on a lake at 81° 26.92 West, at 30° 20.08 North, at exactly North South so that the sun could shine on both sides. The strips were hung on the line the night before and removed at sunset, i.e. 7:33 PM. In the morning the sun shown on the east side of the strips and in the afternoon the sun shown both directly and reflected from the water on the West side. Sep. 14, 2003 was a mostly sunny day so this exposure should represent a worst case of a washing and wearing cycle for UV Protectant treated clothing. These strips were then washed per Table 14.

TABLE 14

| Strip set | Source | Tablet | Wash | Detergent |
|---|---|---|---|---|
| 1 | Control | No | No | N/A |
| 2 | Control | Yes | Hot | None |
| 3 | Control | Yes | Warm | None |
| 4 | Control | Yes | Hot | Tide |

TABLE 14-continued

| Strip set | Source | Tablet | Wash | Detergent |
|---|---|---|---|---|
| 5 | Control | Yes | Hot | Purex |
| 6 | Control | Yes | Warm | Tide |
| 7 | 2 | Yes | Hot | None |
| 8 | 6 | Yes | Warm | Tide |
| 9 | 4* | No | Warm | Tide |
| 10 | 4 | Yes | Hot | Tide |

The foregoing description of the specific embodiments will so fully reveal the general nature of the invention that others can, by applying current knowledge, readily modify and/or adapt for various applications such specific embodiments without undue experimentation and without departing from the generic concept, e.g., the present invention can be used commercially or industrially, as well as domestically, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A UV-protectant material in unit dosage form, adapted to impart UV-blocking to clothing in water, and further adapted to be used in a washing machine, comprising:

a UV-protectant composition in pellet or tablet form capable of disintegrating in water;

said UV-protectant composition comprising a UV-protectant dye capable of being absorbed or adsorbed onto fibers of clothing and in an amount sufficient to impart UV blocking to said clothing;

at least two additional components which provide at least one of some matrix, dispersion and disintegration functions to said pellet or tablet;

wherein said additional components comprise a sugar and croscarmellose sodium;

said pellet or tablet having a weight of about 3-8 grams; and wherein said UV-protectant dye is present in an amount of 8% to 60% based on the total weight of said pellet or tablet.

2. The UV-protectant material of claim 1 wherein said tablet or pellet comprises a solidified melt or a compressed powder.

3. The UV-protectant material of claim 1 wherein said pellet or tablet has a weight of about 4 grams and the amount of UV-protectant dye is 12% to 35% based on the total weight of said pellet or tablet.

4. The UV-protectant material of claim 1 wherein said pellet or tablet has a weight of about 4 grams and a composition as follows:

| | |
|---|---|
| Dextrose | 64% |
| Sorbitol | 10% |
| UV Protectant Dye | 21% |
| Croscarmellose Sodium | 4% |
| Magnesium Stearate | 1%. |

5. In a method of imparting UV-protection to clothing in a domestic washing machine, comprising running the domestic washing machine containing clothes desired to be imparted with UV-blocking, together with a UV protectant dye, the improvement wherein said UV protectant dye is placed in said washing machine in a unit dosage form in accordance with claim 1.

6. A UV-protectant material in unit dosage form, adapted to impart UV-blocking to clothing in water, and further adapted to be used in a washing machine, comprising:

a UV-protectant composition capable of disintegrating in water;

said UV-protectant composition comprising a UV-protectant dye capable of being absorbed or adsorbed onto fibers of clothing and in an amount sufficient to impart UV blocking to said clothing;

two additional components which provide at least one of some matrix, dispersion and disintegration functions to said composition;

wherein said additional components comprise a sugar and croscarmellose sodium;

said unit dosage form having a weight of about 3-8 grams; wherein said UV-protectant dye is present in an amount of 8% to 60% based on the total weight of said composition; and wherein said composition is in a form in which it can be used in individualized doses of two different sizes.

* * * * *